US007397898B2

(12) United States Patent
Holland et al.

(10) Patent No.: US 7,397,898 B2
(45) Date of Patent: Jul. 8, 2008

(54) X-RAY GENERATOR AND METHOD

(75) Inventors: William P. Holland, New Milford, CT (US); Timothy Holland, Southbury, CT (US); Joseph Suffredini, Warwick, RI (US)

(73) Assignee: Parker Medical, Inc., Bridgewater, CT (US)

( * ) Notice: Subject to any disclaimer, the term of this patent is extended or adjusted under 35 U.S.C. 154(b) by 0 days.

(21) Appl. No.: 11/374,490

(22) Filed: Mar. 13, 2006

(65) Prior Publication Data

US 2006/0153337 A1 Jul. 13, 2006

Related U.S. Application Data

(62) Division of application No. 10/655,485, filed on Sep. 3, 2003, now Pat. No. 7,012,989.

(60) Provisional application No. 60/408,069, filed on Sep. 3, 2002.

(51) Int. Cl.
*H01J 35/06* (2006.01)
*H01J 35/18* (2006.01)

(52) U.S. Cl. ..... 378/136; 378/137; 378/140

(58) Field of Classification Search ..... 378/134, 378/136, 137, 138, 140
See application file for complete search history.

(56) References Cited

U.S. PATENT DOCUMENTS

| | | | | |
|---|---|---|---|---|
| 2,911,538 | A | | 11/1959 | Otto |
| 3,942,015 | A | | 3/1976 | Huxley |
| 3,962,583 | A | | 6/1976 | Holland et al. |
| 4,132,916 | A | | 1/1979 | Hueschen et al. |
| 4,227,112 | A | | 10/1980 | Waugh et al. |
| 4,336,476 | A | | 6/1982 | Holland et al. |
| 4,521,903 | A | * | 6/1985 | Braun ..... 378/144 |
| 4,674,109 | A | | 6/1987 | Ono |
| H312 | H | | 7/1987 | Parker |
| 4,679,220 | A | | 7/1987 | Ono |
| 4,689,809 | A | | 8/1987 | Sohval |
| 4,719,645 | A | | 1/1988 | Yamabe et al. |
| 4,821,305 | A | | 4/1989 | Anderson |

(Continued)

FOREIGN PATENT DOCUMENTS

| | | |
|---|---|---|
| JP | 60257047 A | 12/1985 |

(Continued)

*Primary Examiner*—Edward J. Glick
*Assistant Examiner*—Chih-Cheng G Kao
(74) *Attorney, Agent, or Firm*—McCarter & English, LLP

(57) ABSTRACT

An x-ray tube comprises an envelope, an anode target rotatably mounted within the envelope, and a cathode and window assembly mounted within the envelope and spaced relative to the anode. The cathode and window assembly includes an electrically insulative ceramic base defining an x-ray transmissive window therethrough, a recess formed within the electrically insulative base adjacent to a peripheral portion of the x-ray transmissive window, a filamentary electrode received within the recess, first and second metalized conductive surfaces formed on a surface of the recess on opposite sides of the filamentary electrode and substantially electrically isolated relative to one another, a first terminal electrically connected to the first metalized conductive surface, a second terminal electrically connected to the second metalized conductive surface, and a high voltage cable receptacle located on a second side of the electrically insulative ceramic base.

26 Claims, 9 Drawing Sheets

U.S. PATENT DOCUMENTS

| | | | | |
|---|---|---|---|---|
| 4,823,371 | A | 4/1989 | Grady | |
| 4,872,189 | A | 10/1989 | Frankel et al. | |
| 4,873,709 | A | 10/1989 | Hattori et al. | |
| 4,885,490 | A | 12/1989 | Takahara et al. | |
| 4,920,551 | A | 4/1990 | Takahashi et al. | |
| 4,928,296 | A | 5/1990 | Kadambi | |
| 4,939,762 | A | 7/1990 | Baba et al. | |
| 5,018,181 | A | 5/1991 | Iversen et al. | |
| 5,031,200 | A * | 7/1991 | Plessis et al. | 378/136 |
| 5,105,456 | A | 4/1992 | Rand et al. | |
| 5,293,040 | A | 3/1994 | Watanabe et al. | |
| 5,303,281 | A * | 4/1994 | Koller et al. | 378/134 |
| 5,397,183 | A | 3/1995 | Lu et al. | |
| 5,581,591 | A | 12/1996 | Burke et al. | |
| 5,629,970 | A | 5/1997 | Woodruff et al. | |
| 5,745,546 | A | 4/1998 | Hell et al. | |
| 5,978,448 | A | 11/1999 | Bristol | |
| 6,041,100 | A | 3/2000 | Miller et al. | |
| 6,134,299 | A | 10/2000 | Artig | |
| 6,333,968 | B1 | 12/2001 | Whitlock et al. | |
| 6,412,979 | B1 | 7/2002 | Hell et al. | |
| 6,477,236 | B1 | 11/2002 | Anno et al. | |
| 6,560,315 | B1 | 5/2003 | Price et al. | |
| 6,594,340 | B2 | 7/2003 | Saito | |
| 7,012,989 | B2 * | 3/2006 | Holland et al. | 378/124 |

FOREIGN PATENT DOCUMENTS

| | | | |
|---|---|---|---|
| JP | 61154033 | A | 7/1986 |
| JP | 04010342 | A | 1/1992 |
| JP | 05028939 | A | 2/1993 |

* cited by examiner

X-RAY GENERATOR AND METHOD

CROSS-REFERENCE TO PRIORITY APPLICATION

This patent application is a divisional of and claims priority under 35 U.S.C. § 120 to co-pending U.S. patent application Ser. No. 10/655,485 filed Sep. 3, 2003, now U.S. Pat. No. 7,012,989, which claims priority under 35 U.S.C. § 119(e) to U.S. Provisional Patent Application No. 60/408,069, filed Sep. 3, 2002, entitled "Multiple Grooved X-ray Generator", each of which is hereby expressly incorporated by reference in its entirety as part of the present disclosure.

FIELD OF THE INVENTION

This invention relates generally to X-ray generators and, in certain embodiments, is concerned more particularly with an X-ray tube having a rotating anode provided with a peripheral spiral or multiple groove track. In a currently preferred embodiment, the X-ray tube is geometrically arranged to produce a conical X-ray beam(s) that may define a substantially more uniform intensity cross-section across the cone than previously achievable from a prior art X-ray tube having a radially sloped annular tracked target disc. Some of the unique characteristics of the currently preferred embodiments of the invention are also related to X-ray generators of the stationary anode type.

BACKGROUND INFORMATION

Generally, an X-ray tube of the rotating anode type comprises a tubular envelope having therein an anode target disc, which is axially rotatable and provided with a radially sloped annular focal track adjacent to its periphery.

The material of the radially sloped annular focal track is generally chosen such as to be comprised of elements having a high atomic number and to have a high melting temperature and low vapor pressure, such as tungsten or a tungsten-rhenium alloy. In other instances, a lower atomic number element or alloy may be used such as, for example, Molybdenum or Titanium-Zirconium-Molybdenum alloy, in order to take advantage of molybdenum characteristic energies in the X-ray beam as they might interact with the object being irradiated. In further instances by way of example, Cerium or Lanthanum borides might be used for similar objectives.

The angle of the radial slope determines the actual irradiated image size and is directly proportional to it. The intensity of the X-rays at the image plane is indirectly but inversely proportional to the angle of the radial slope. In some instances, the radial slope has been arranged such as to have two or more adjacent angles for multiple purpose instruments, by way of example.

A rectangular focal spot area disposed radially on the focal track usually is axially aligned with a linear filamentary cathode. In practice, the cathode may contain two independent linear filaments, generally of differing sizes. The alignment of the filaments in the cathode head is such as to provide electron bombardment from each of the filaments to the same rotating anode focal spot area, a condition called superimposition. The rectangular focal spot area is radially aligned with an X-ray transparent window in the tube envelope. Due to the rotation of the target disc, the surface of the focal track in the focal spot area is constantly changing, thus providing for greater short time interval power than X-ray tubes of the stationary anode type.

The thermionically emitting filamentary cathode, a tungsten coil by way of example, is preferred because of electron emission reproducibility and its ability to withstand ion bombardment emanating from or near the anode.

The cathode is electrically isolated from the anode structure by an insulator usually in the form of a part of the envelope structure. In operation, the cathode thermionically emits electrons, which are electrostatically focused and accelerated onto the focal spot area with sufficient energy to generate X-rays. A useful portion of the X-rays radiating from the focal spot area passes in a divergent beam from the tube through the X-ray transparent window in the tube envelope. However, since the window is radially aligned with the focal spot area, the X-ray beam appears to be emanating from a radial projection of the focal spot area, which is generally referred to as the "effective" focal spot of the tube. In this radial projection, the focal spot along the radial direction is foreshortened such that the foreshortened focal spot acts in the aligned radial direction as an approximate point source of X-ray radiation.

An edge portion of the beam emanating from the "effective" focal spot extends along the sloped surface of the focal spot area and consequently acquires a number of characteristics traceable to what may be termed as the "heel effect". For example, this edge portion of the X-ray beam, as compared to other portions thereof, appears to be emanating from a focal spot of radically different size, configuration, intensity and, because of strong self absorption of the track material, of different beam energy spectral distribution, thereby degrading uniformity of resolution in a radiograph produced by the X-ray beam, for example. As a consequence of the focal spot foreshortening from a projection on a radially sloped annular focal track, there is a significant variation in both intensity and effective focal spot size.

In some instances, two or more separate and independent focal spot areas, displaced from each other, are provided. For example the two focal spot areas might be displaced 65 millimeters, for example, for purposes of stereo irradiation and subsequent stereo imaging. If this is provided in a single X-ray tube, the single conventional target diameter must be greater than a minimum imposed by the spot displacement. This restriction is often met by using two X-ray tubes. In other instances, a displaced focal spot may be utilized for other purposes, such as reconstruction in X-ray three-dimensional computerized tomography.

The emitted electron beam and/or the emergent X-ray beam can be and are often modulated. The modulation can be in size as in differing focal spot dimensions for imaging gross or fine detail for example, or temporally as sequential bursts of emission synchronized with filming of multiple sequential images, as in angiography and cineradiography, for example, or in energy changes in the X-ray beam energy distribution, as in some bone densitometry. In those instances where multiple beams are used it is often necessary to know which focal spot is doing the irradiation. Herein the modulation can take a number of forms. The foci may be turned active and inactive in a variety of sequences, for example. For foci that are active simultaneously, the emitting intensity of each may be varied at an identifying frequency discernable through a demodulating filter.

The rotating anode tubes generally operate at higher short term intensities by spreading the heat over a greater area than that of the focal spot area and by storing a portion of the heat energy during the short generation time to be dissipated later. The material of the body of the rotating anode disc is chosen such that it provides efficient storage of the thermal energy produced during the short generation time. Generally the heat from the anode target disc is dissipated by means of radiation through the tube envelope and into surrounding electrically and thermally insulating fluid, which transfers the heat energy through the safety housing shield to the ambient surroundings. Care must be taken to shield the radiation and conductive paths from the target to the bearing structure to assure that the maximum bearing temperature is not exceeded.

In some applications, the electrical power supply and control systems for the X-ray tube are amalgamated into one integral package with the X-ray tube, sometimes referred to as a "monoblock system". This provides for ease of assembly in rapid tomographic systems, by way of example, as well as simplification and weight reduction of the X-ray generating system.

SUMMARY OF THE INVENTION

According to an embodiment of the present invention, an X-ray tube of the rotating anode type comprises, in one case, a tubular envelope, preferably but not limited to, a metal-ceramic construction and that may provide integral cooling and anode section grounding. An anode target disc of the X-ray tube is rotatably mounted and includes a peripheral rim surface having disposed therein a plurality of approximately V-shaped focal track grooves axially spaced adjacent to each other for defining the X-ray focal spot or spots along the side crest or base of one or more of the grooves, and provided with defining surfaces of suitable X-ray emitting material such as tungsten, for example. Alternately, the anode target disc may define a spiral cross-sectional approximately V-shaped groove, or a plurality of spiral cross-sectional approximately V-shaped grooves axially spaced adjacent to each other, for defining the X-ray focal spot or spots along the side crest or base of one or more of the grooves, and provided with defining surfaces of suitable X-ray emitting material such as tungsten, for example.

The entire disc may be made of X-ray emitting material or materials and have the peripheral focal track V-grooves disposed in the peripheral rim surface thereof. Alternatively, the disc body may be made of a relatively lighter material, such as graphite, copper or molybdenum alloy, for example, and may include a peripheral rim surface having therein a focal track groove, the surfaces of which are coated, as by chemical vapor deposition, for example, with the X-ray emitting material. As another alternative, the anode disc body may be constructed of a thermally insulating center core section embedded in a larger disc of thermally storing material as described immediately above. Such a construction would provide improved thermal isolation to the bearings of the system, without significantly reducing the target disc storage capacity. In addition, the X-ray emitting material defining the focal track grooves may be provided with an overlayer of more ductile material, such as rhenium or an alloy of rhenium and tungsten, for example.

In one embodiment of the present invention, the adjacent V-grooves may have different X-ray emitting material from each other, such as tungsten-rhenium on one, and molybdenum-titanium-zirconium in another, for example. In another embodiment, the individual V-grooves may have serial sections comprising different X-ray emitting materials, such as Tungsten-Rhenium in a section of the groove circumference, for example an approximately 36 degree arc, followed by molybdenum in the next circumferentially adjacent section, for example another approximately 36 degree arc, and alternating sequentially throughout the 360 degrees of the V-groove length. Similarly, for a spiral V-groove or plurality of spiral V-grooves, there may be serial sections comprising different X-ray emitting materials, such as Tungsten-Rhenium in an initial approximately one-half integral section of the spiral V-groove track length, followed by molybdenum in the next adjacent approximately one-half integral section of the spiral V-groove section, and continuing in like manner to the end of the spiral V-groove length. Further, the adjacent target groove angles may differ one from another.

The anode target disc is rotatably mounted on a shaft. In one embodiment of the present invention, the shaft is positioned substantially concentrically to the principal axis of the anode target disc and is supported on two (2) substantially concentric bearings, one on either side of the anode disc rotating on an axle fixedly attached to the X-ray tube envelope. This arrangement of the bearings on both sides of the rotating anode disk balances the load evenly or substantially evenly between the bearings in contrast to the usual cantilever method of suspension which places approximately twice the load on the near bearing compared to the far one, for example. In one embodiment, the rotational driving elements comprise electrically and magnetically conducting discs mounted on the rotating shaft within the X-ray tube envelope coaxially with the anode target disk and disposed one on each side of the anode disc. The conducting discs are electro-magnetically coupled to external stator coils which are positioned external to the X-ray tube envelope and in as close propinquity to the driving discs as is practicable. One advantage of the embodiment of the present invention that includes two rotor discs, as opposed to a single cylindrical rotor as in a typical prior art rotating anode X-ray tube, is that there is available almost twice the accelerating energy to start rotation as compared to the typical prior art tube.

Additionally, provision can be made for independent translational motion of the anode disc in the direction of the rotational axis, for example, by arranging a translational bearing, such as a cylinder containing ball bearings. In one embodiment of the present invention, the ball bearings are allowed to roll in the tube axial direction but are restrained from rotational motion which, in turn, supports the inner support bearing of the rotational pair, which is non-rotating with respect to the outer shaft which imparts the rotary motion to the anode disk. Also, in one embodiment of the present invention, the translational driving elements are linear solenoids, within the inner and outer translational shafts.

In another embodiment of the present invention, the translational and/or the rotational elements are encoded such that the rotational and translational position of the target can be determined continuously. The encoding may be accomplished by any of numerous means that are currently or later become known for performing this function, such as optical encoding using a series of light and dark masks that are viewed via fiber optics In another embodiment of the present invention, the anode target disc is rotationally mounted on a shaft positioned concentrically to the principal axis of the anode target disc. The shaft is preferably supported on two (2) substantially concentric bearings, one on either side of the anode disc rotating on an axle fixedly attached to the X-ray tube envelope, wherein the fixed axle is hollowed to permit the flow of cooling fluids through it. Alternatively, the fixed axle may be the translational support of a linear bearing system which itself is supported on an axle fixedly attached to the X-ray tube envelope, wherein the fixed axle is hollowed to permit the flow of cooling fluids through it. The hollowed volume may be partially filled, with expanded copper or aluminum for example, in order to increase the heat transfer surface area and induce turbulent fluid flow to thereby improve the heat transfer efficiency.

In another embodiment of the present invention, the anode target disc may be mounted to the bearing so as to minimize thermally conductive paths from the disc to the bearing structure with a so-called "heat dam". The rotational driving elements or rotors comprise two tubular rotors substantially coaxially mounted on a rotating shaft and disposed on both sides of the anode target disc and coupled electro-magnetically to closely positioned stators mounted externally to the X-ray tube envelope. The rotor material is arranged to support the induced electrical currents using copper, for example, and closely proximate to the electrical current carrying material is a material disposed to carry the magnetic field such as iron, for example.

One advantage of the embodiments of the present invention that include two rotors, as opposed to the single cylindrical rotor in the conventional system, is that the double rotor configuration provides almost twice the accelerating energy to start rotation compared to the conventional tubes. Moreover, the envelope of the X-ray tube of the present invention may be configured to provide close thermal coupling of the target grooves with the cooling envelope structure. Additionally, the envelope may provide for radiation shielding of the rotor structure from the heat of the target anode.

The induction motor for rotating the anode disc of the X-ray tube of the present invention may comprise flattened coil stators and disc rotors in order to minimize weight and space. In addition, there may be elements included which are disposed to provide the driving force for translational motion in like manner to the rotational elements, but disposed for translational motion, such as a linear solenoid, for example.

In one embodiment of the present invention, the translational and/or the rotational elements are encoded such that the rotational and translational position of the target can be determined continuously. The encoding is accomplished by any of numerous different means that are currently or later become known for performing this function, such as optical encoding using a series of light and dark masks and viewed via fiber optics.

In this configuration, the anode target disc grooves may take the form of two (2) or more adjacent spirally disposed grooves defining a predetermined anode target track length that is significantly greater than the circumferential length of the anode target tracks previously described. The inclusion of a translational linear rotor within the rotational drive system with an externally coupled set of translational coils, provides a means for tracking the anode target disc axially such that the stationary position of the exciting electron beam, and hence the relatively stationary position of the focal spot area, may consistently remain within the spiral groove.

In one embodiment of the present invention, the X-ray tube includes means for electrically isolating the anode and the cathode structures from each other such that an electrostatic field of up to about 150 kilovolts can be safely imposed between them to support the acceleration and focusing of the electron beam into the focal spot area of the anode target disc. Also in a currently preferred embodiment of the present invention, the means for electrically isolating takes the form of an insulating, hollow cylinder comprising substantially equally spaced coaxial metallic annular washers separated by coaxial hollow insulating cylinders. If desired, the cylinder may be tapered.

The annular washers interspersed between the insulating cylinders are maintained at an electrical potential voltage that is directly proportional to its linear position within the stack by means known to those of ordinary skill in the pertinent art, such as using a resistive voltage divider or tuned resistive voltage divider, by way of example. Alternately, discrete voltages from a specialized power supply may also impose this forced potential division, such as, for example, a monoblock power supply. This arrangement affords a significant improvement in the high voltage stability of the insulating stack and reduces the probability of high voltage arcing. If desired, a variation of the proportional voltage on specific washers may be made to adjust the electron optics of the accelerating stack and, in turn, correct the position and/or shape of the electron beam.

In one embodiment of the present invention, the cathode electron source and focusing/steering electrodes are hermetically attached to the larger end of the insulating cylinder to, in turn, support the X-ray transparent window. This structure may serve to collimate the X-ray beam, absorb off focus radiation and define the cross-section of the conical X-ray beam. Preferably, the X-ray transparent window is fabricated of electrically conductive material, such as beryllium, for example, and is electrically connected to the structure such that it becomes part of the beam forming structure.

The form of the focusing/steering electrodes may be molded into the cathode ceramic structure and made electrically conductive by a metallic film attached to the ceramic form by methods known to those of ordinary skill in that pertinent art, such as by vacuum vapor deposition or metalizing, for example. This provides a precise form of electrodes, which in contrast to discrete part assemblies, will not move over time.

Further, this structure facilitates assembly of the X-ray tube into a monoblock construction wherein the X-ray tube, safety housing shield and the control/power supply are integrated into a single package. The power supply may have multiple stages electrically connected to the beam forming sections so as to impress a fixed voltage to each section, and thereby distribute the voltage gradients in a manner that reduces high voltage stress points that otherwise might cause electrical breakdown.

In operation, the anode target disc is rotated to move the X-ray emitting material of the focal track through the focal spot area aligned with the window at a suitable rotational speed; and the cathode is heated electrically to a temperature corresponding to the desired rate of electron emission. The grid electrodes surrounding the heated filament are maintained at a suitable electrical potential with respect to the cathode for suppressing electron emission from the cathode or directing electrons from the cathode through the focusing electrodes. This suppression may be used to code the beam intensity via frequency and/or amplitude modulation. The focusing and grid electrodes may be provided by metalizing the ceramic cathode structure with appropriate conductive films. In addition, the ceramic cathode structure may be formed to independently provide multiple electron sources, which may be used simultaneously or sequentially. Further, the electron beam may be simultaneously or sequentially focused on different V-grooves of the anode target disc, thereby providing X-ray sources with different offset origins. The metalized ceramic areas with appropriate beam deflection voltages facilitate the displacement of the focal spot to multiple locations with position synchronized to the image detector circuitry. The anode target disc is maintained at a suitably high positive potential with respect to the cathode for beaming the electrons through the focusing electrodes and onto the focal spot area with sufficient kinetic energy to generate X-rays which radiate from the focal spot area. The resulting X-ray beam emanating from the focal spot area in the focal track groove and passing through the radially aligned window in the tube envelope a conical beam, for example, or other desirable cross section, of more uniformity and specific intensity (intensity per input energy) than an X-ray beam from a similar focal spot area.

The particular geometry of the "V"-groove focal spot provides for more efficient X-ray generation than with conventional configurations. When the incident electron beam is at or near grazing angles to the target surface (about 70° to about 90° to the surface normal) the beam penetration depth is reduced, thus reducing the X-ray bremstrahlung escape depth and attendant self-absorption and, in turn, enhancing the X-ray intensity. Moreover, in prior art targets the reflected primary and emitted secondary electrons return to the target at areas at target potential outside the focal spot region, creating heat and X-rays, which only contribute to undesirable background and the need for heat removal. In the V-groove, on the other hand, most of these electrons impinge on the congruent target surface enhancing useful X-ray intensity.

The X-ray intensity, energy spectrum and focal spot size and shape vary significantly over the useful irradiation area in conventional rotating anode target discs of the prior art as a consequence of foreshortening, which is a compromise between achievable X-ray beam intensity and the imaging requirement for an "approximately point source" of radiation. The apparent shape of the focal spot distribution along the aligned radial line appears as an almost square rectangle, slightly longer in the tube axial direction (called the focal spot length). Observations of the focal spot at angles increasing from the aligned radial in the grazing emission direction show a focal spot of increasingly shorter length, the shortening being in direct proportion to the viewing angle. In the same manner, observations of the focal spot at angles increasing from the aligned radial away from the grazing emission direction show a focal spot of increased length, the increase being in direct proportion to the increased viewing angle. Viewing the focal spot at increasing angles in the width direction shows a focal spot of distribution skewed to a rhomboid shape, whose angle increases with increases in the viewing angle. Viewing at combined angles in the width and length directions shows focal spots of a parallelogram shape increasingly varying in proportion to the increase in either angle.

One advantage of the preferred "V"-groove geometry of the X-ray tubes of the present invention is that it significantly reduces these variations in size and intensity over the useful irradiation area. In the "V"-groove geometry, the focal spot is distributed to the two radially sloped annular focal tracks. Since the foreshortening variations are directly proportional to increasing angles for each track, the variations in one track are mostly compensated by the inverse variation of the other adjacent track.

The preferred embodiments of the present invention further allow dual energy or intensity, either simultaneously or sequentially. In one embodiment of the invention, two cathode assemblies are operated at different voltages with respect to the anode and have their electron beams focused at the same region or adjacent regions of the target. The cathodes may be powered by a single switched power supply or dual power supplies. Dual power supplies can be operated sequentially or simultaneously. The dual energies can be accommodated in either a single groove (with superimposed foci, for example) or dual/multiple grooves.

The distribution of X-ray photon energies, in particular the production of elementally characteristic photon energies, is dependent upon the target elemental material. By providing in certain embodiments of the present invention different target materials to the different grooves and/or groove portions in a target, different energy spectral distributions can be generated whose simultaneous or sequential use is advantageous to the depiction of otherwise obscure images, such as, CT images, computed medical images, Baggage inspection, customs inspections of shipment and/or shipping containers, stereo viewing, material analysis and material uniformity in complex shapes.

In a conventional rotating anode target, track temperature builds up towards the melting or warping points upon multiple passes of the track under the electron beam bombardment because the heat arrives faster than the target body can conduct it away or radiate it to surrounding areas. In contrast, by taking advantage of multiple grooves in the anode periphery or switching from one groove to another during exposure, the X-ray tubes of the present invention provide an effectively longer track, and for a given track specific power input, provide a longer time of X-ray generation.

Stereo viewing can be achieved by synchronously viewing images from X-ray sources that are displaced by a distance of about 65 millimeters, for example (referred to as the interocular distance). This can be achieved in a conventional larger target disc by using two cathodes to bombard 65 millimeter separated focal spot areas on a single target disc. However, the target must be large compared to the interocular distance in order to avoid focal spot foreshortening aberrations, which will affect the apparent three-dimensional reconstruction. When using a peripheral "V" or like groove in the X-ray tubes of the present invention, on the other hand, the focal spots are less susceptible to foreshortening aberrations, and further, the provision for simultaneous use of multiple grooves provides an axial displacement component to the existing radial component, thus providing for the interocular displacement upon a smaller diameter target disc.

Other advantages of the preferred embodiments of the X-ray tubes of the present invention will become apparent in view of the following detailed description of preferred embodiments and accompanying drawings.

BRIEF DESCRIPTION OF THE DRAWINGS

For a better understanding of this invention, reference is made to the following more detailed description of the preferred embodiments and the accompanying drawings wherein.

DETAILED DESCRIPTION OF THE PREFERRED EMBODIMENTS

Figure 1:
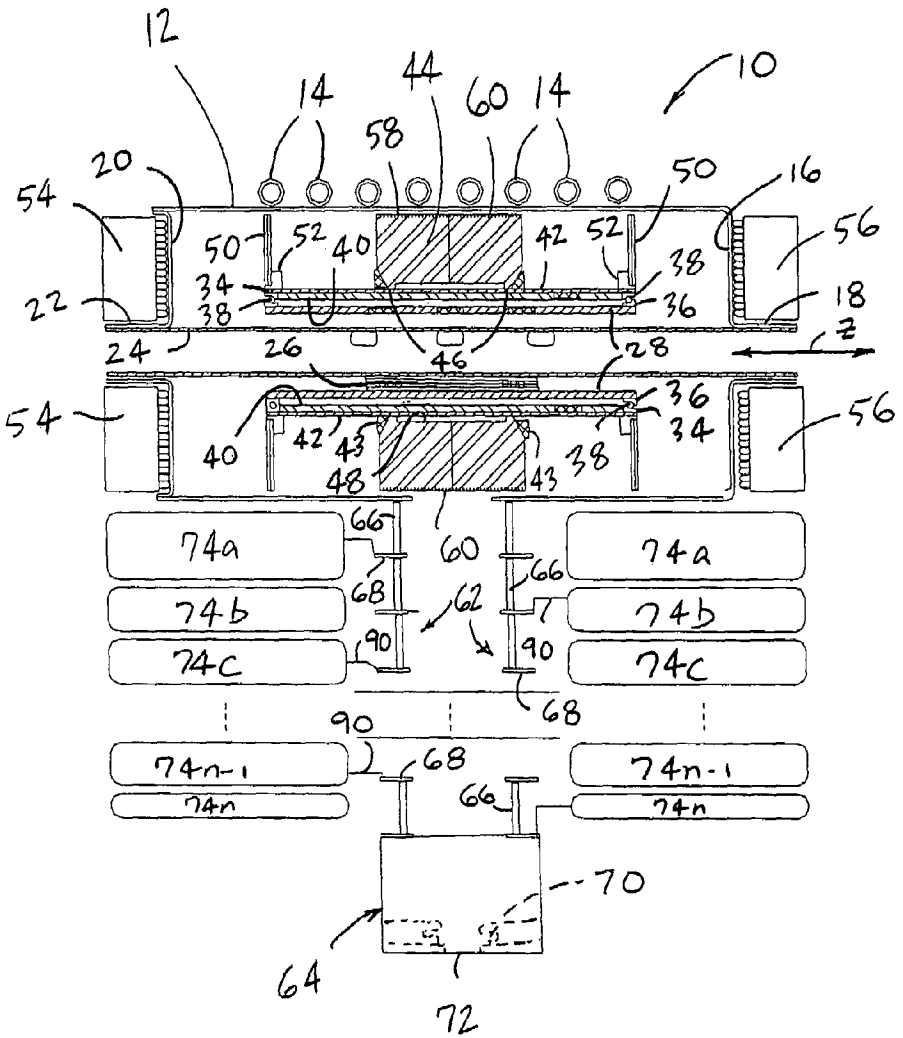
FIG. 1 is a somewhat schematic, cross-sectional view taken through the principle axis of the anode bearing and the principle axis of the anode to cathode insulator of a first embodiment of an X-ray tube, and illustrating the anode section, the anode cathode insulator, the cathode assembly with electron guns and X-ray window, and the monoblock modular power supply and control system.

Referring to the drawings wherein like characters or reference numerals designate like parts, there is shown in FIG. 1 an X-ray tube 10 of the rotating anode type including an evacuated tubular envelope 12. The cylindrical envelope 12, preferably made of nonmagnetic metal, copper alloy or austenitic (300 series) stainless steel, for example, surrounding the rotating anode, is continuously cooled via fluid, such as chilled water for example, flowing in hollow coils 14 thermally connected to the envelope, by any of numerous means that are currently or later become known to those skilled in the pertinent art. One end of the cylindrical envelope 12 is inwardly flared at 16 and integrally joined to a reduced diameter end portion 18 coaxially aligned with the axis of the cylindrical envelope 12. The other end 20 is configured to close the open end of the tubular envelope 12 and contains a reduced diameter end portion 22 as at the other end. The other end 20 can be hermetically sealed to the tubular envelope 12 by any of numerous means that are currently or later become known to those skilled in the pertinent art, such as edge welding. The reduced diameter end portions 18 and 20 are sized to accept the bearing structure of the rotating anode tube 10.

Figure 2:
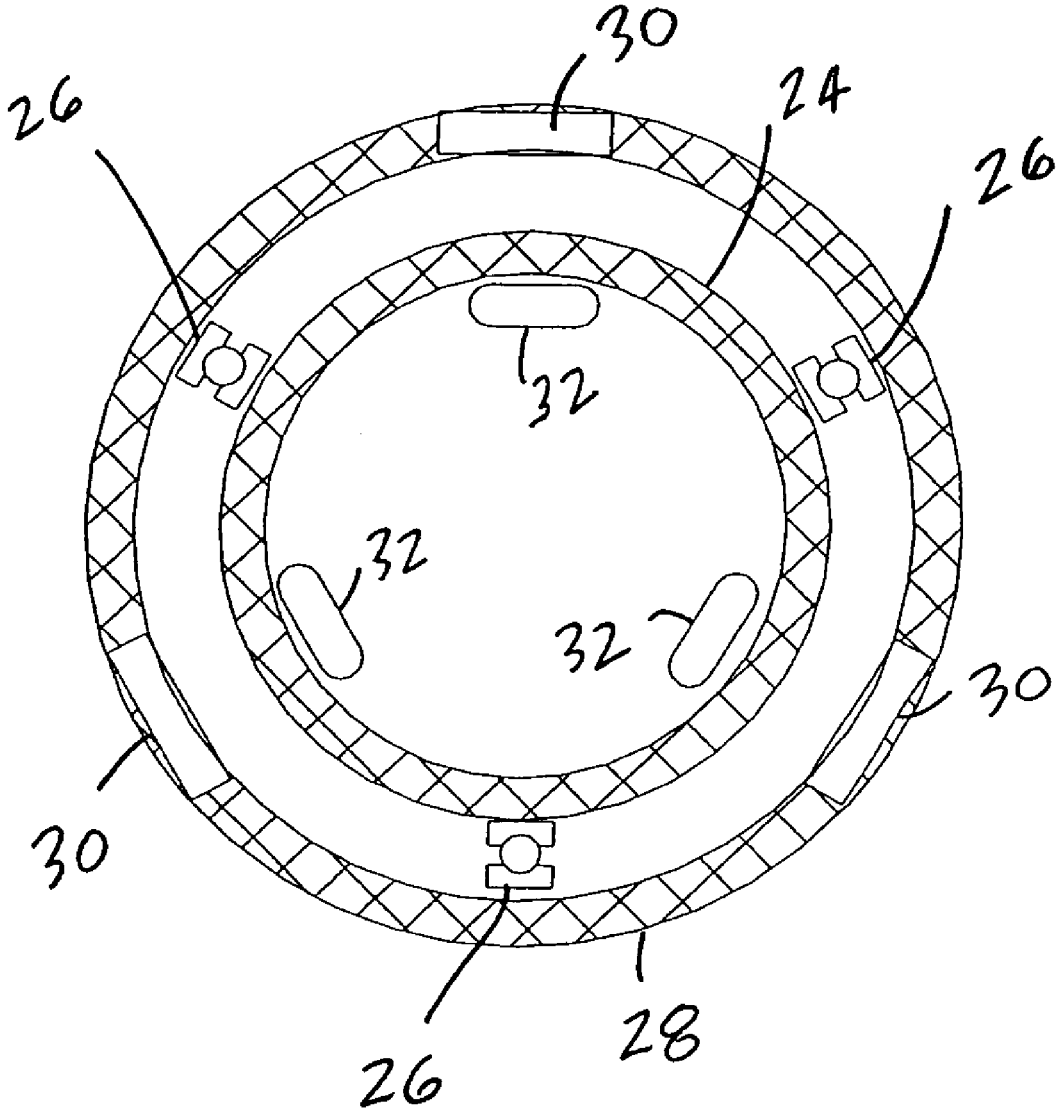
FIG. 2 is a cross-sectional view of the translational bearing of the X-ray tube of FIG. 1 taken through the plane of the anode target midline between the anode flat faces and perpendicular to the translational bearing principle axis.

A translational bearing inner shaft 24 is hermetically sealed to the reduced diameter end portions 18 and 22 by means well understood to those skilled in the pertinent art, such as direct edge welding, or edge welding to an intermediate collar which is, in turn, brazed to the translational bearing inner shaft 24. The translational bearing inner shaft 24 is fashioned of nonmagnetic metal such as austenitic (series 300) stainless steel, for example, is hollow throughout, and is concentric with the principle anode axis. Three (3) linear ball bearing assemblies 26 (FIG. 2), or other translational bearing means known to those skilled in the pertinent art, are affixed to the outer periphery of the translational bearing inner shaft 24 parallel to the principle anode axis and equally spaced around the circumference (approximately 120 degrees apart). There is shown in FIG. 2 elements located within the translational bearing inner shaft 24. A hollow outer translational bearing shaft 28 is supported on the three (3) linear ball bearing assemblies 26, is fashioned from magnetic material, such as martensitic stainless steel (400 series), for example, and provides for the translational motion of the anode in the direction of the principle anode axis "Z". Also embedded into the outer translational bearing shaft 28 are three equally spaced magnetic elements 30, whose properties include a relatively high curie point temperature, such as samarium cobalt magnets, for example. Located within the translational bearing inner shaft 24 in the same plane and directly facing the three equally spaced magnetic elements 30 are three electromagnetic coils 32. Two additional sets of three magnets 30 and three electromagnetic coils 32 are similarly located adjacent to the planes of the flat faces of the rotating anode disc 44.

Again referring to FIG. 1, two sets of bearing outer races 34 and bearing inner races 36 are fixedly attached to the outer translational bearing shaft 28, one at each end, and are each provided with a full complement of ball bearings 38 of appropriate diameter. The two sets of bearings are also held in place and separated by a bearing spacer and split ring spacer 40, and the anode mounting shaft 42 is, in turn, fixedly attached to the bearing outer races 34.

The anode disk 44 is mounted in the lateral center of the anode mounting shaft 42, fixedly attached to it by methods familiar to those of ordinary skill in the pertinent art, such as the use of conical rings 43 with internal threads, for example, and located such that the axis of the target disc 44 is coincident with the rotational axis of the bearing structure 34, 36. The inner surface 46 of the target disc 44 may be constructed such that the surface area of the target disc 44 in thermal contact with the anode mounting shaft 42 is minimized by constructing a recess 48 within the surface.

Two (2) rotor assemblies 50 are also fixedly mounted to the anode mounting shaft 42, one at each end of the shaft. The rotor assemblies are held in place by rotor mounts 52. The rotor assemblies 50 are composed of two conjoined disks, one of a good electrical conductor material, such as copper, for example, and the other of a good magnetic material, such as iron, for example. The electrical conductor material is positioned on the anode mounting shaft 42 such that the good electrically conducting material is facing the ends of the envelope 16 and 20, respectively.

The rotational and translational position of the anode disk 44 must be known and controlled. This may be done in a number of ways by means of sensors and electronic feedback and control as understood by those of ordinary skill in the pertinent art. By way of example, in those instances where the positional sensing is derived optically through shaft encoding, the encoding patterns can be placed on the rotor disks 50 and read through detector systems mounted in the inward flare 16 and the cap closure 20 of the tubular envelope 12.

Two (2) stator structures 54 and 56, each forming one-half of an induction motor are mounted one at each end of the tubular envelope 12 facing the anode rotor disks 50 and inductively coupling to them. The magnetic force is applied to each disk 50 at a greater moment arm than in conventional cylindrical rotors in conventional X-ray tubes, thereby improving rotational torque. In instances where the anode disk is incurring translational motions while simultaneously rotating the anode disk, one of the dual flat rotors is moving away from its inductive coil while the other is moving toward it, thereby compensating for the effect of distance variations between the induction stator and its corresponding rotor.

The anode disk 44 includes a peripheral rim surface 58 having disposed therein a spiral V-shaped cross-sectioned groove 60, or a plurality of spiral V-shaped cross-sectioned grooves 60 axially spaced adjacent to each other, for defining the X-ray focal spot or spots ("FS") along the side's crest or base of one or more of the grooves. The V-grooves 60 define the full focal track. The path length of the focal track is one of the key parameters that define the maximum operating energy and power in the production of X-rays. In conventional X-ray tubes, the track length is increased by increasing the anode disk diameter and subsequently substantially increasing the size and weight of the entire tube structure. Use of the spiral V-groove(s), on the other hand, allows the track length to be significantly increased while retaining most of the smaller scale tube size. This configuration also allows adjacent spiral V-grooves of the same or different X-ray emitting material, or of the same or different V-groove angle and/or depth geometry.

As also shown in FIG. 1, an insulator assembly 62 separates the anode disk 44 and cathode assembly 64 and withstands the high voltage potential between these two elements. The insulator assembly 62 comprises a multiplicity of hollow insulator cylinders 66 formed of aluminum oxide ceramic, for example, interleaved with a like multiplicity of electrically conducting accelerating annular rings 68. The hollow cylinders 66 are hermetically sealed to the respective electrically conductive annular rings 68, and the conductors are therefore made of material suitable for sealing to the ceramic insulators in a manner known to those of ordinary skill in the pertinent art, such as Kovar™, for example. As can be seen, the insulators 66 and annular rings 68 share a common centerline axis. When the electron accelerating and X-ray producing voltage is applied to the tube high voltage insulator assembly 62, the annular rings 68 allow such voltage to be more evenly distributed along the insulator by use of a series voltage divider circuit attached to each ring 68. Thus, the rings 68 and associated circuitry provide a means for adjusting the equipotential distribution and the electron accelerating field between the anode 44 and cathode 64, thereby enabling the capability to correct focusing of the electron beam beyond the cathode gun 70. The alignment of the cathode gun 70 and window 72, and the series insulators 66 and rings 68 in relationship to the anode grooves 60, define the focal spot area and the resulting useful X-ray beam.

The window 72 is made of X-ray transparent material such as beryllium, for example, and hermetically sealed into the face of the cathode assembly 64 using methods well known to those of ordinary skill in the pertinent art.

Figure 3:
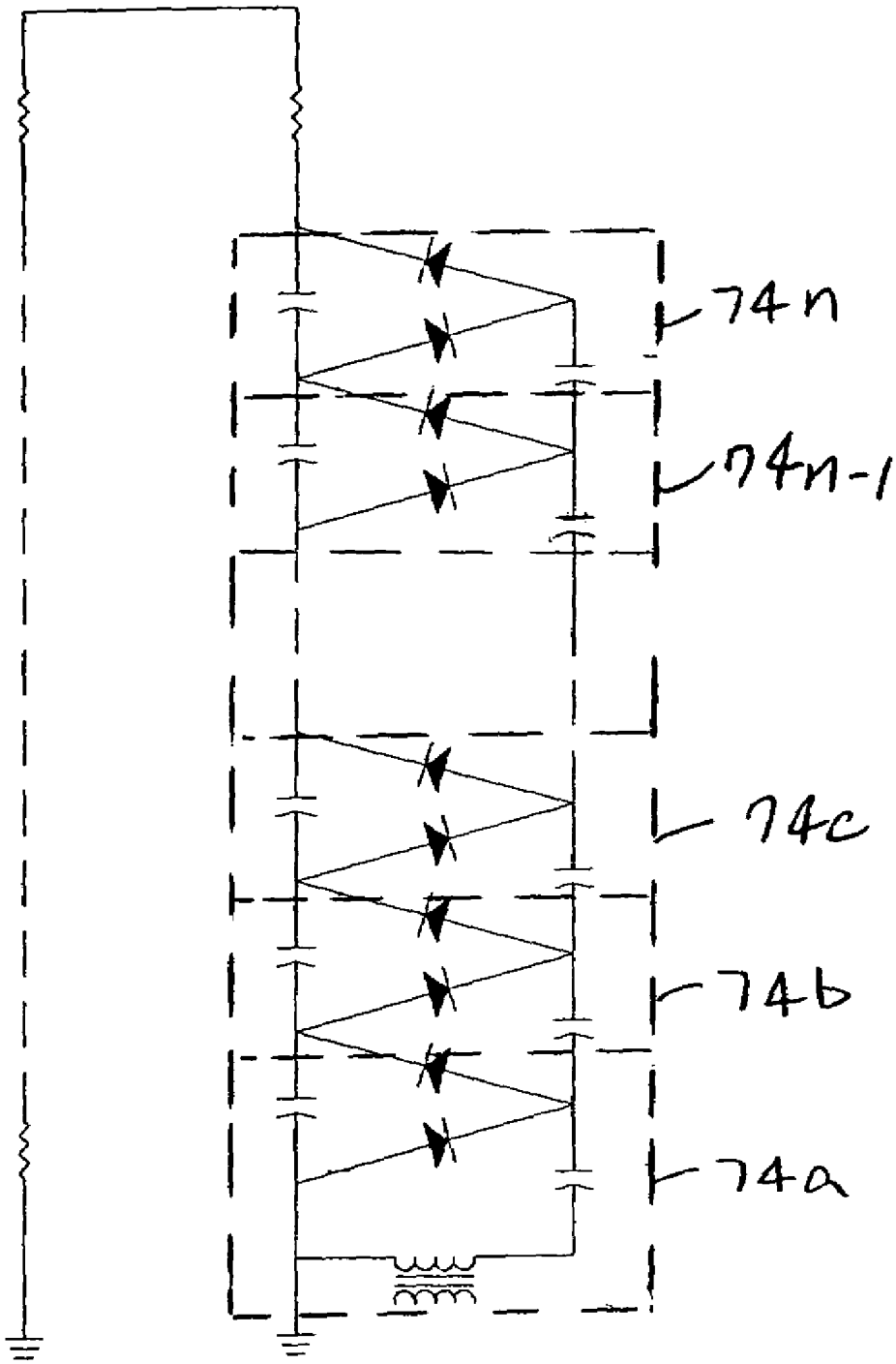
FIG. 3 is a schematic illustration of the Cockroft-Walton circuit forming the voltage multiplier circuit used in the plurality of modules that operate and control the X-ray tube of FIG. 1.

Alternatively, the annular rings 68 may be controlled in proportionate voltage by direct connection to a voltage source, such as the modules 74*a*-74*n* of a monoblock power supply and control, as shown schematically in FIGS. 1 and 3.

Figure 6B:
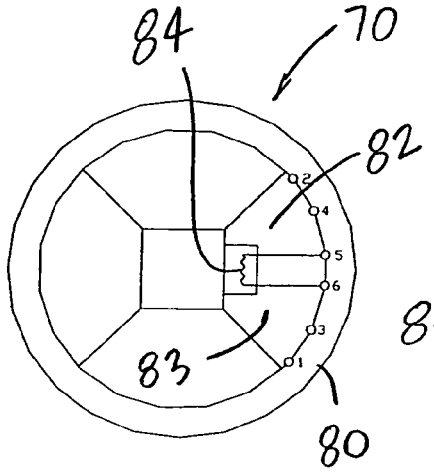
FIG. 6B is a plan view of four electron-focusing guns of FIG. 6A.
Figure 6C:
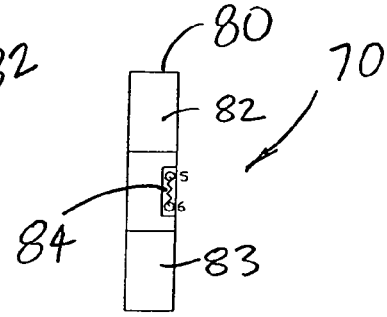
FIG. 6C is a side elevational view of the electron-focusing guns of FIG. 6*b;*
Figure 6A:
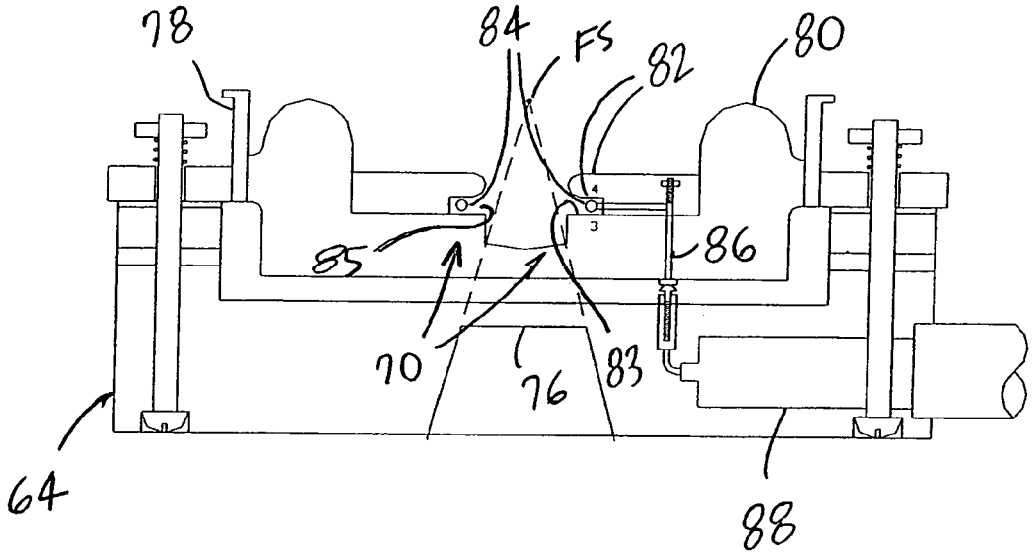
FIG. 6A a sectional view of the cathode guns and end sealing plate and window of either of the X-ray tubes of FIGS. 1-5, and further showing a high voltage cable connection with the opposite cable end connected to an anode grounded power supply, such as when the high voltage power supply is not integral to the X-ray source assembly.

Referring to FIG. 6A, the cathode gun and window assembly 64 comprises a ceramic end sealing plate and window 76 with an appropriate metal attachment flange 78 made of Kovar™, for example, sealed to the plate 76 by methods well known to those familiar with the art. A metalized ceramic deflection electrode 80 and a second half metalized ceramic electron gun 82 are each truncated approximately 90 degree circular sectors whose metalized surfaces are electrically insulated one from another and surround a linear filament thermionic electron emitter 84. Further independent metalized electrodes are provided on the ceramic wall facing either end of the linear filaments. These metalized electrodes are deposited by means known to those of ordinary skill in the pertinent art utilizing molybdenum-manganese titanium hydride, for example. Electrical connections to each of these electrodes are depicted for one quadrant in FIG. 6B illustrating the six (numbered 1 to 6) terminal conductors for the respective quadrant.

Figure 4:
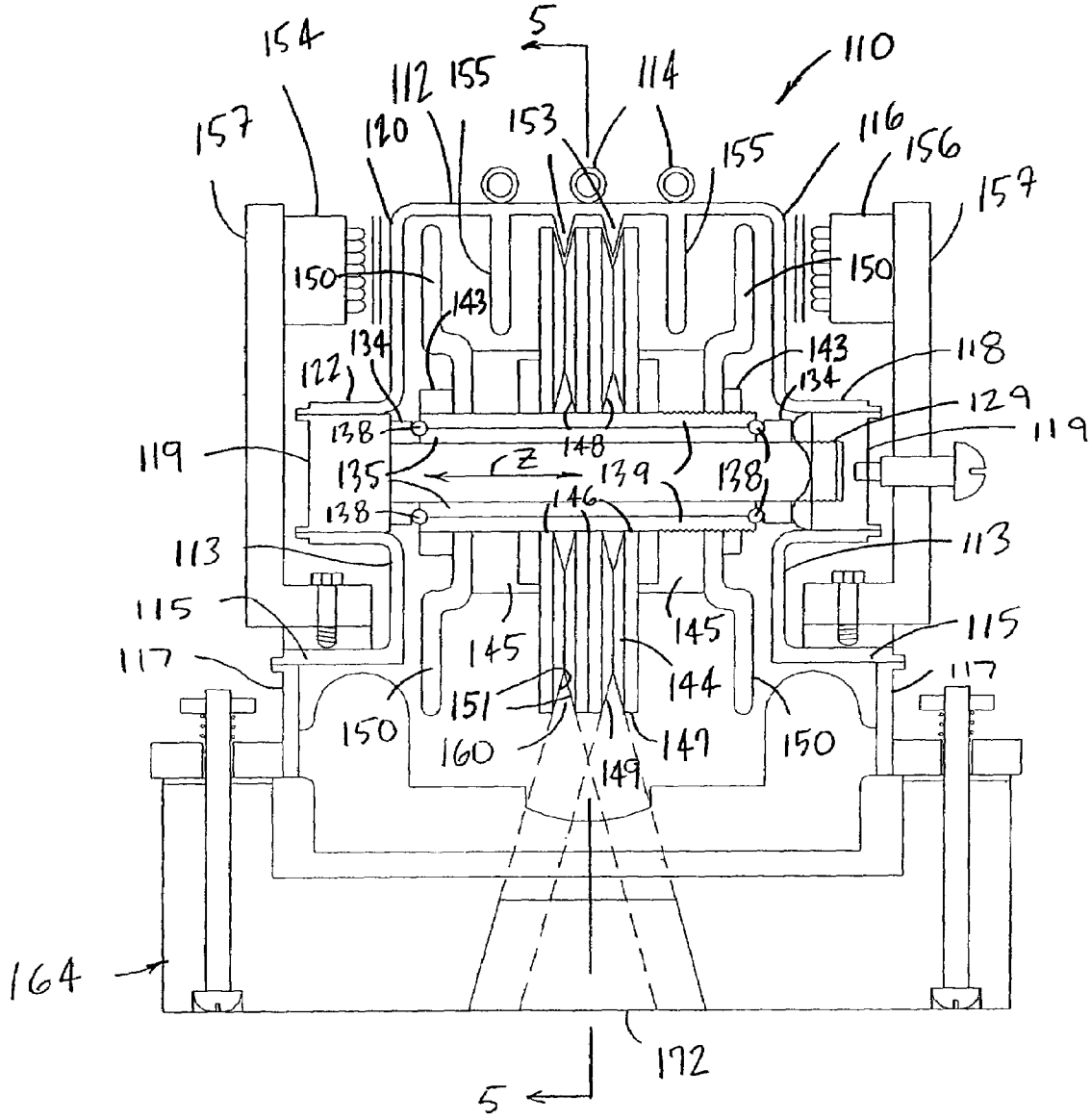
FIG. 4 is a cross-sectional view taken through the principle axis of the anode portion of a second embodiment of a rotating anode type X-ray tube.
Figure 5:
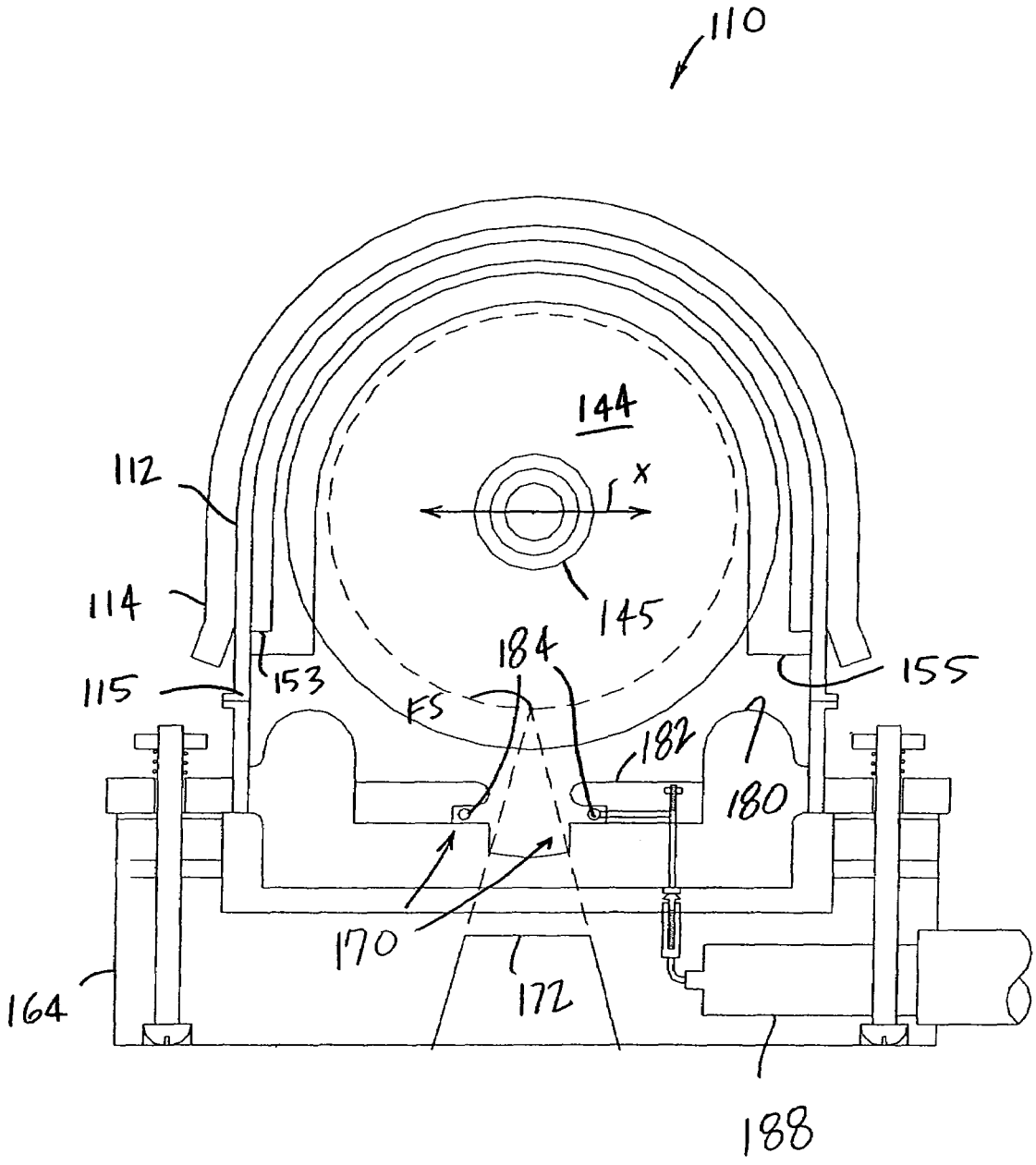
FIG. 5 is a cross-sectional view taken along line 5-5 of FIG. 4.

As can be seen in FIGS. 6A and 6B, and with reference to Table 1 below, filament 84 is electrically connected to terminal conductor #6; terminal conductor #5 is the common or reference voltage; terminal # 4 is connected to metalized conductive surface 82 located on one side of the filament 84, and the voltage at this conductor is controlled to control the deflection of the electron beam in the "−Z" direction (the Z axis is shown in FIG. 4); terminal #3 is connected to metalized conductive surface 83 located on an opposite side of the filament 84 relative to the metalized conductive surface 82, and the voltage at this conductor is controlled to control the deflection of the electron beam in the "+Z" direction; terminal # 2 is connected to another metalized conductive surface (not shown) that is located with reference to the filament 84 such that the voltage at this conductor may be controlled to, in turn, control the deflection of the electron beam in the "−X" direction (the X axis is shown in FIG. 5); and terminal # 1 is connected to another metalized conductive surface (not shown) that is located with reference to the filament 84 such that the voltage at this conductor may be controlled to, in turn, control the deflection of the electron beam in the "+X" direction. As shown in FIG. 6A, the filaments 84 (only two shown) are angularly spaced relative to each other about the periphery of the x-ray transmissive window 76. In the embodiment of the present invention illustrated, up to four such filaments may be employed to create up to four different electron beams, wherein each filament and its respective metalized conductive surfaces and terminal conductors are located in a respective quadrant of the ceramic cathode head. The cathode head includes a ceramic base 80, and the ceramic base defines an annular recess or groove 85 extending about the periphery of the x-ray transmissive window 76 and receiving therein the filaments 84. The metalized conductive surfaces are formed on the ceramic insulator 80, and as shown typically in FIG. 6A, the metalized conductive surfaces 82 and 83 are formed on the walls of the groove 85 on opposite sides of the respective filament 84 relative to each other, and in close proximity thereto, to control the voltage potential between these surfaces (including the modulation and/or switching thereof), and in combination with the control of the voltages applied to the other metalized conductive surfaces associated with the respective filament, to precisely control the deflection, shape and/or size of the electron beam emitted by the respective filament. The metalized conductive surfaces are electrically isolated from one another, and in the illustrated embodiment, each of these surfaces is formed of the same conductive material, such as molymanganese.

One advantage of using the metalized conductive surfaces to control the electron beams is that the sizes and shapes of these surfaces can be relatively precisely controlled. In addition, because of the relatively low coefficients of thermal expansion of ceramic insulators, in comparison, for example, to metal cathode heads used in the prior art, and the insulative properties of the ceramic cathode, more filaments can be placed in a smaller area, and the size and/or direction of electron flow can be more precisely controlled, in comparison to prior art configurations. In addition, because the metalized conductive surfaces are placed immediately adjacent to the filaments, the deflection of the beams occurs at the source of the electrons, and thus facilitates more precise control over same.

In the illustrated embodiment, there may be up to four sets of these assemblies, which would provide for up to four independent emitters within the cathode head guns. Each of these quadrants is electrically controlled by signals provided through appropriate feed-thrus 86 connected to a high voltage cable 88 containing up to 6 independent conductors. If several filaments are employed, they can be connected in parallel to a single cable 88, or the x-ray tube assembly can employ several cables connected to different filaments, if desired.

Accordingly, electron beam deflection and focal spot size control are accomplished by providing appropriate voltage signals at cathode potential through the high voltage connected cable 88. In the illustrated embodiment, and as described above, there are four deflection plates formed by the metalized conductive surfaces in each quadrant constituting a set of deflection plates. The filament thermionically emits electrons, which are formed into a beam and accelerated toward the target 44. As summarized above and in Table 1 below, one pair of electrodes can be used for deflection of the electron beam in the direction parallel to the target grooves 60, and the second pair can be used for deflection of the electron beam in a direction perpendicular to the target grooves 60. Deflection voltages are preferably between about −50 volts and about −3500 volts with respect to the cathode voltage.

As may be recognized by those of ordinary skill in the pertinent art based on teachings herein, there are combinations of grid voltages that will prevent all electrons from entering the acceleration field and reaching the target 44 by making the focal spot size equal to zero with bias voltage up to about 5000 Volts, for example. This capability serves to provide a means for coding the X-ray beam produced by a particular electron beam with an intensity modulation, the frequency or amplitude of which may uniquely identify a particular X-ray beam. Thus, deflection plates such as the metalized conductive surfaces can serve to adjust and control/stabilize electron emission. As indicated above, Table 1 below provides an example of the connections of the multi-conductor high voltage cable 88 to the control electrodes of one quadran

TABLE 1

| CONDUCTOR NUMBER | FUNCTION DEFLECTION OR FILAMENT | VOLTAGE TO COMMON |
|---|---|---|
| 1 | DEF (+X) | 5 KVDC |
| 2 | DEF (−X) | 5 KVDC |
| 3 | DEF (+Z) | 3 KVDC |
| 4 | DEF (−Z) | 3 KVDC |
| 5 | Common | Reference |
| 6 | Filament | Filament Voltage (typically about 3-20 volts off Reference) |

Referring again to FIG. 1, cross sections of modules 74*a*-74*n* of a monoblock control system are shown along with electrical connections 90 to annular rings of the anode-cathode insulator assembly 62. Each module 74*a*-74*n* contains a multiplier circuit of diodes and condensers providing a stage of the total voltage required by the tube. FIG. 3 shows a Cockroft-Walton circuit schematic of the module multiplier by way of example.

Alternative Embodiments

In FIG. 4 another embodiment of an X-ray tube is indicated generally by the reference numeral 110. The X-ray tube 110 is substantially similar to the X-ray tube 10 described above, and therefore like reference numerals preceded by the number "1" are used to indicated elements. As shown in FIG. 4, the X-ray tube 110 is of the rotating anode type and includes an evacuated tubular envelope 112. In this embodiment, the anode structure is changed to preclude translational motion of the anode disk, and the multiplicity of adjacent V-grooves 160 is comprised of complete annular rings, each located on a single circumference of the cylindrical surface of the anode disc 144.

The cylindrical envelope 112, preferably made of metal, copper alloy or steel, for example, surrounding the rotating anode, is continuously cooled via fluid, such as chilled water, for example, flowing in hollow coils 114 thermally connected to the envelope, by means known to those familiar with the state of the art. Both ends of the cylindrical envelope 112 are inwardly flared at 116, 120 and integrally joined to a respective reduced diameter end portion 118, 122, respectively, coaxially aligned with the axis of the cylindrical envelope 112. The end portions 118, 122 are sized to accept the bearing structure of the rotating anode tube 110. A second cylinder 113, of like radius to the radius of envelope 112, is integrally and hermetically attached to envelope 112 in a manner known to those of ordinary skill in the pertinent art, such as by welding, for example, and aligned such that the principle axis of cylinder 113 is perpendicular to, and intersects the axis of envelope 112. The cylinder 113 is terminated by an integral and hermetically sealed annular ring 115 in a manner known to those of ordinary skill in the pertinent art, such as by welding. The annular ring 115 is, in turn, sealed with a metal ring mounted, and hermetically sealed insulator 117, containing the X-ray tube cathode structure 164 and X-ray window 172.

An attachment collar 119 of a metal suitable for fixedly and hermetically sealing to the reduced diameter end portion 122 by means well understood by those of ordinary skill in the pertinent art, is sealed to the bearing structure support 129. The bearing structure support 129 includes means at either end for connecting and appropriately sealing to a cooling means, such as flowing chilled fluid, for example. The bearing structure support 129 is axially hollow and may be fitted throughout the cavity with a thermally conductive mesh material, which increases the thermally conductive surface area within the cavity, and induces a turbulent or like flow through the cavity to thereby increase the efficiency of removal of heat from the bearing structure. The bearing split inner race 134 and bearing split inner race spacer 135 are fixedly attached to the bearing structure support 129 by integral and matching screw threads, for example, of the bearing structure support 129 and the bearing split inner races 134, locking in place the bearing split inner race spacer 139, for example. These are positioned such that the bearing split inner races 134 are concentrically spaced along the axis of the envelope 112 and symmetrically spaced with respect to the axial intersection of the envelope axis and the cylinder 113. The bearing races 134 and 135 are filled with ball bearings 138, for example. The bearing structure is completed with the inclusion of the integral outer race spacer and support 139. The outer race spacer and support 139, which rotates on the ball bearings 138, has the outer diameter configured to support the anode target disc 144, the rotor discs 150, the target locking nuts 145, and the rotor locking nuts 143. The anode target disc 144 is transversely situated within the cylindrical envelope 112, and is mounted on outer race spacer and support 139 such that the axis of the target disc 144 is coincident with the rotational axis of the bearing structure and is equally spaced between the planes of the ball bearings 138. It is mechanically and electrically fixed in place by conventional means, such as the threadingly engaged target locking nuts 145. The inner surface 146 of the target disc 144 may be constructed such that the surface area of the target disc 144 in thermal contact with outer race support 139 is minimized by constructing arcuate grooves 148 within the surface 146.

Colinearly disposed in the peripheral rim surface 147 of the anode target disc 144 are a plurality of arcuate openings of focal track grooves 149 which extend radially to a predetermined depth into the body of the target disc 144. Grooves 144 preferably are continuous and extend annularly about the axial centerline of the target disc 144. In the radial direction, each groove 149 may define a V-shaped cross-sectional configuration with openings disposed in the rim surface 147 and radially tapering wall surfaces 151, which join one another in the body of the target disc 144 at the base of each groove. The tapered wall surfaces 151 may comprise the material of the target disc 144, or may comprise focal track layers of material deposited thereon.

Extending radially into the grooves 149 from the envelope 112 may be heat receptor ribs or fins 153, placed in close proximity to the elevated temperature target face and which extend in a 180 degree arc along the cylindrical wall of the envelope 112, more easily visualized by reference to FIG. 5, and are thermally connected to the envelope 112 wall and may serve to enhance the radiation heat transfer from the groove 149 walls to the external environment. In addition, radial heat shields 155 may be imposed between the anode target disc 144 and the rotor discs 150. The heat shields 155 may be thermally connected to the envelope 112 and may extend 180 degrees along the envelope 112 cylindrical wall, more easily visualized by reference to FIG. 5.

Threadingly engaged rotor locking nuts 143 fixedly mount the rotor discs 150 to the integral bearing outer race and spacer 139. The rotor discs 150, the induction rotor portion of the induction motor which rotate the anode target disc 144, may be constructed of a laminate of copper and iron or steel, for example, such that the discs provide both magnetic coupling to the external stator coils 154, 156 and also provide an efficient material to allow electron induced current circulation within the discs. The external field coils 154, 156 are supported and maintained in as close proximity with the rotor discs 151 as practicable by respective support brackets 157 of well-known construction to those familiar with the state of the art.

The X-ray tube 110 may include anode-cathode insulator assembly, as described above at 62 in connection with FIG. 1, and includes a cathode assembly 164 and multiple guns 170, as described previously.

In this embodiment, the configuration also allows adjacent V-grooves of the same or different X-ray emitting material, or of the same or different V-groove angle and/or depth geometry. Because the cathode guns 170 may be independently operated, offset and multiple focal spot use is afforded. Coding as mentioned above is also afforded in the same manner.

Figure 7:
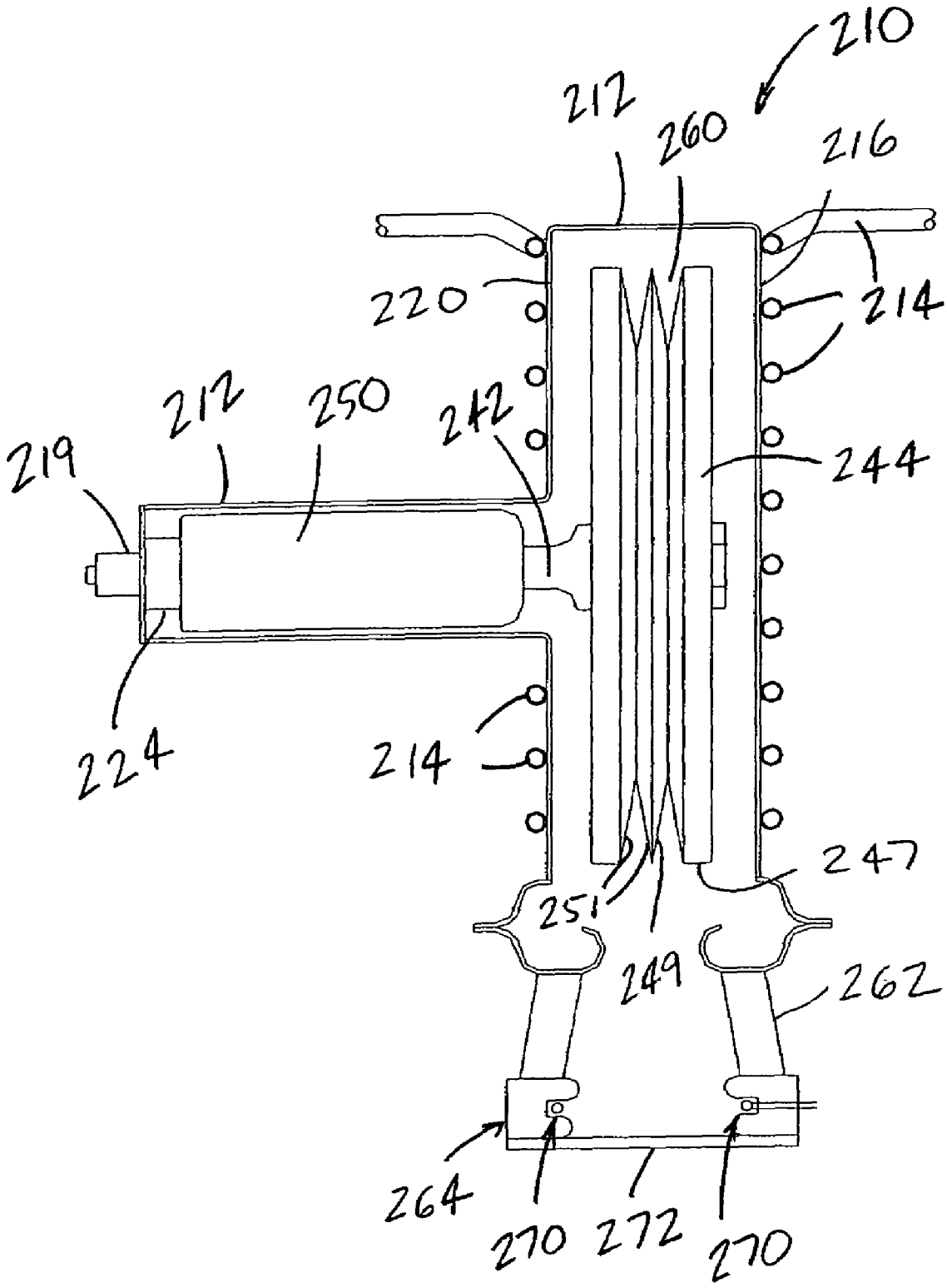
FIG. 7 is a cross-sectional view of another embodiment of an X-ray tube including only one induction rotor mounted in the tube envelope in a cantilevered manner.

In FIG. 7, another X-ray tube assembly is indicated generally by the reference numeral 210. The X-ray tube assembly 210 is similar in many respects to the X-ray tube assembly 110 described above with reference to FIGS. 4 and 5, and therefore like reference numerals preceded by the numeral "2" instead of the numeral "1" are used to indicate like elements. A primary difference of the X-ray tube 210 is that the induction rotor 250 is configured such that the rotation bearing sets are located on only one side of the anode disk 244 such that the anode disk is supported on the bearings (not shown) in a cantilever manner, as is well known to those of ordinary skill in the pertinent art. Accordingly, this embodiment may be constructed to allow anode disk rotation only, or alternatively, may be constructed to allow both rotation and axial translation. In the latter case, the rotor 250 and associated bearings and shafts may be constructed in accordance with the teachings set forth above in connection with FIG. 1 or in connection with FIG. 8 below, and further, would require additional space in the axial direction between the anode target disk 244 and the adjacent walls of the envelope 212 to permit such axial translation. In the event that the x-ray tube 210 does not include axial translation as indicated, the tube may employ different focal spots axially spaced in the grooves 260 relative to each other, and/or may move the focal spot axially from one groove or groove portion to another. If, on the other hand, the x-ray tube includes axial translation of the target, the position of the focal spot or spots may be fixed, and thus there would not be a need to adjust the alignment of the associated optical systems that otherwise might be required with movement of the focal spot(s).

Figure 8:
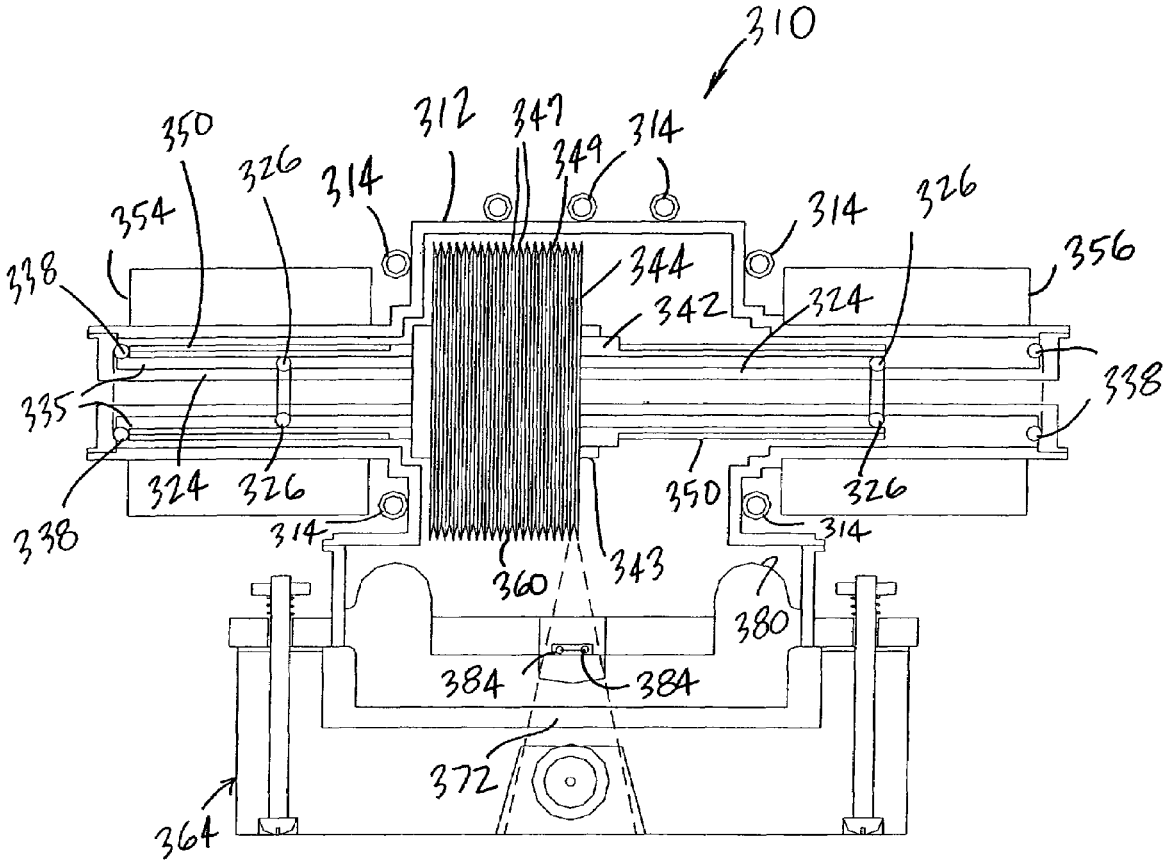
FIG. 8 is a somewhat schematic, partial cross-sectional view of another embodiment of an X-ray tube wherein the target employs multiple helical grooves, or collinear grooves, and means for translational target motion simultaneous with rotational target motion.

In FIG. 8, another X-ray tube assembly is indicated generally by the reference numeral 310. The X-ray tube 310 is similar in many respects to the X-ray tube assembly 210 described above with reference to FIG. 7, and therefore like reference numerals preceded by the numeral "3" instead of the numeral "2" are used to indicate like elements. In this embodiment, the rotor structure is changed to provide both target axial translation and simultaneous rotation about the axis. As shown in FIG. 8, the heat input rate capability of the rotating anode target disc 344 for time intervals less than about 10 seconds is directly dependent on the tangential length of the focal track. Collinear grooves 360 are defined by the effective radius of the focal track. A helical groove focal track increases the track length by a factor equal to the number of coils of the helix, and this factor is the improvement factor for the maximum heat input rate. If desired, multiple V-grooves may be parallel to each other in the helix. FIG. 8 shows an anode target disc 344 with such multiple V-grooves mounted on a cylindrical rotor sleeve 350 and target disc support shaft 342, which is allowed to rotate about the tube axis and translate parallel to the tube axis on ball bearings 338 and 326, for example. The rotational and translational motions are induced by dual coil stators 354, 356, including rotational induction coils and translational solenoid coils. Means for coding the rotational and translational positions of the rotor-solenoid is provided in a manner understood by those of ordinary skill in the pertinent art. In the case of optical encoding, detection and feedback, for example, an optical encoding pattern, well known to those of ordinary skill in the pertinent art, can be imprinted on the outer diameter of the cylindrical rotor and illuminated and read via fiber optics and detectors mounted on or about the tube envelope.

Figure 9A:
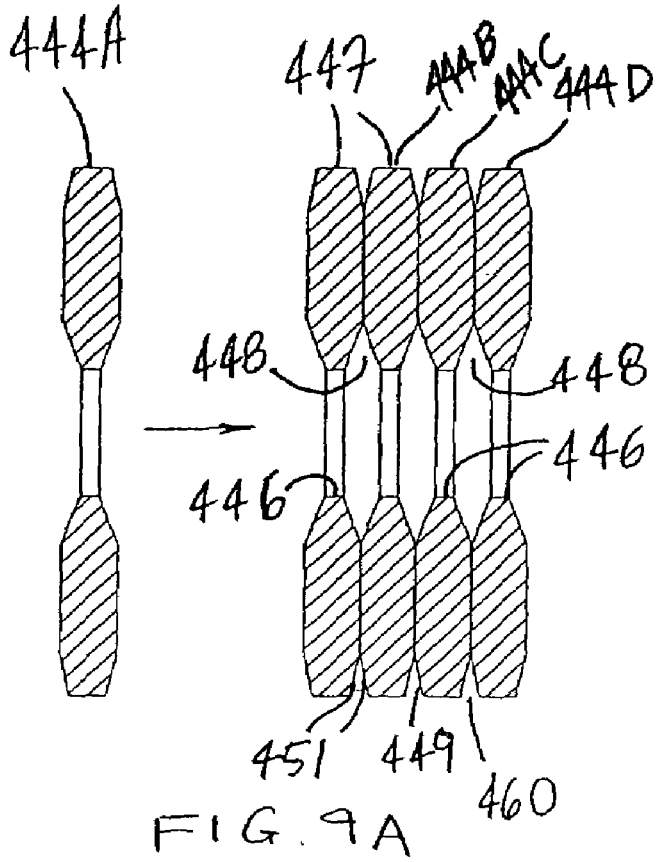
FIG. 9A is a cross-sectional view of an anode target disc that includes multiple grooves and illustrating a first mode of fabrication wherein a plurality of discs are clamped or otherwise fixedly secured together to form the multiple grooved target disc.
Figure 9B:
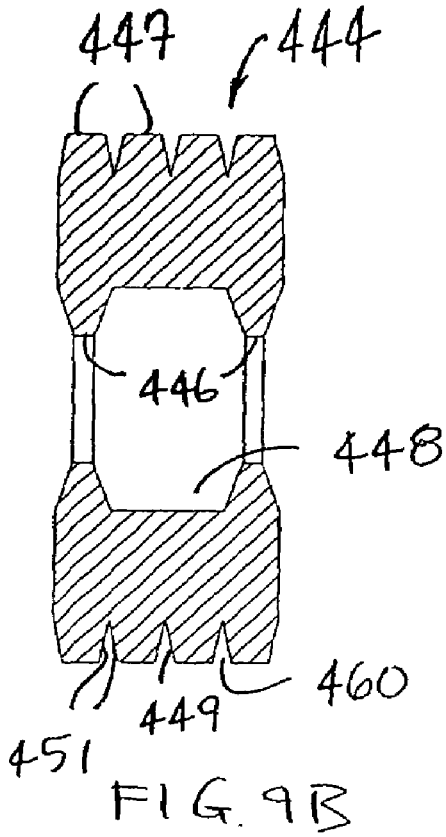
FIG. 9B is a cross-sectional view of an anode target disc that includes either a single helical groove, or multiple grooves and illustrating a second mode of fabrication wherein the target disc is formed as a single part.

In FIGS. 9A and 9B, another embodiment of the anode target disc is indicated generally by the reference numeral 444. The anode target disc 444 is similar in many respects to each of the target discs described above, and therefore like reference numerals preceded by the numeral "4", or preceded by the numeral "4" instead of the numerals "1", "2", or "3", are used to indicate like elements. In this embodiment of the anode disc, applying an efficient X-ray emitting layer to the walls of the target anode grooves 449, such as tungsten-rhenium, for example, may be done by processes known to those of ordinary skill in the pertinent art, such as by chemical vapor deposition, for example. As shown in FIG. 9A, a single disc may be fabricated entirely of the chosen emitting material, such as tungsten-rhenium, for example, or it may be fabricated of a lighter material, such as molybdenum-titanium-zirconium, by way of example, with a coating layer of tungsten-rhenium, or Molybdenum-Rhodium, or X-ray target material providing a desired X-ray spectral content, for example, on the surfaces which could serve as the focal track. Then, the single disc 444A can be combined with a plurality of other discs (e.g., discs 444B, 444C and 444D) to form a composite disk, wherein each disk may be formed of the same material, or they may be formed of different materials, and arranged with the adjacent discs sharing a common axis. The plural disks can be fixedly secured to one another by, for example, locking them together on a common shaft with lock nuts at one or both ends. However, as may be recognized by those of ordinary skill in the pertinent art based on the teachings herein, the plural disks may be combined in any of numerous different ways that are currently or later become known for performing this function. As shown in FIG. 9B, on the other hand, a solid disc 444 can be formed; however, this approach may, in some instances, offer more of a fabrication challenge than combining a plurality of separate discs, as shown in FIG. 9A. In the multi-disk approach of FIG. 9A, the V-grooves 449 formed by the adjacent track's grooves can substantially match those in the solid disc in form, fit and function. As may be recognized by those of ordinary skill in the pertinent art based on the teachings herein, various targets of selected spectral content can be assembled in one tube for multiple energy applications.

As may be recognized by those of ordinary skill in the pertinent art based on the teachings herein, numerous changes and modifications may be made to the above described and other embodiments without departing from the scope of the invention as defined in the appended claims. For example, the anode target discs and v-shaped grooves thereon may take any of numerous different shapes and/or configurations that are currently or later become known. Similarly, the rotational and/or axial translational bearing and/or drive systems may take any of numerous different configurations that are currently or later become known for performing these functions. In addition, the anode, cathode, envelope and other components of the x-ray tubes of the invention may be made of any of numerous different materials, or combinations of materials, that are currently known, or later become known for forming any of these components. Further, the x-ray tube may include any desired number of focal spots, the focal spots may take any of numerous different shapes, the focal spots may be translated from one groove or groove portion to another, and/or the grooves or groove portions may be axially and/or rotatably driven relative to the focal spot(s). In addition, the cathode, including any of the components thereof, may take any of numerous different configurations that are currently or later become known. Accordingly, this detailed description of preferred embodiments is to be taken in an illustrative, as opposed to a limiting sense.

What is claimed is:

1. An x-ray tube comprising:

an envelope;

an anode target rotatably mounted within the envelope; and a cathode and window assembly mounted within the envelope and spaced relative to the anode, wherein the cathode and window assembly includes an electrically insulative ceramic base defining an x-ray transmissive window therethrough, a recess formed on a first side of the electrically insulative base adjacent to a peripheral portion of the x-ray transmissive window, a filamentary electrode received within the recess, a first metalized conductive surface formed on a surface of the recess on one side of the filamentary electrode, a second metalized conductive surface formed on a surface of the recess on an opposite side of the filamentary electrode relative to the first metalized conductive surface and substantially electrically isolated relative to the first metalized conductive surface, a first terminal electrically connected to the first metalized conductive surface, a second terminal electrically connected to the second metalized conductive surface, and a high voltage cable receptacle located on a second side of the electrically insulative ceramic base, wherein the ceramic base electrically insulates the high voltage cable receptacle from the filamentary electrode and metalized conductive surfaces, and at least one of an electron beam size, shape, and direction emitted by the filamentary electrode is controllable by controlling a voltage differential between the first and second metalized surfaces.

2. An x-ray tube as defined in claim 1, wherein the recess is defined by an approximately annular groove extending about the periphery of the x-ray transmissive window.

3. An x-ray tube as defined in claim 1, further comprising a plurality of filamentary electrodes angularly spaced relative to each other about the periphery of the x-ray transmissive window, and a plurality of pairs of first and second metalized surfaces and first and second terminals, wherein each pair of first and second metalized surfaces and first and second terminals is associated with a respective filamentary electrode.

4. An x-ray tube as defined in claim 3, wherein each filamentary electrode transmits a respective electron beam onto a respective focal spot on the anode target.

5. An x-ray tube as defined in claim 1, wherein the cathode includes a plurality of electron beam sources, and each electron beam source transmits a beam onto a focal spot of the anode target.

6. An x-ray tube as defined in claim 5, wherein the focal spots of a plurality of electron beam sources are superimposed on one another.

7. An x-ray tube as defined in claim 5, wherein a plurality of electron beam sources transmit respective beams onto different focal spots.

8. An x-ray tube as defined in claim 5, wherein a plurality of electron beam sources transmit respective beams onto different focal spots substantially simultaneously.

9. An x-ray tube as defined in claim 5, wherein the plurality of electron beam sources are at least one of (a) operable simultaneously and (b) operable serially.

10. An x-ray tube comprising:

an envelope;

a cathode and window assembly mounted within the envelope and including an electrically insulative ceramic base defining an x-ray transmissive window, a cathode including a filament for emitting an electron beam onto a focal spot located on an internal side of the ceramic base, and a high voltage cable receptacle located on an external side of the electrically insulative base, wherein the ceramic base extends between the cathode and high voltage cable receptacle and electrically insulates one from the other; and an anode target rotatably mounted within the envelope and defining a focal track corresponding to the focal spot and emitting x-rays therefrom upon impingement of the electron beam thereon.

11. An x-ray tube as defined in claim 10, further comprising means formed on at least one surface adjacent to the filament for creating a voltage differential across the filament and, in turn, controlling at least one of the electron beam size, shape, and direction.

12. An x-ray tube as defined in claim 11, wherein said means is defined by first and second metalized conductive surfaces formed on opposite sides of the filament relative to each other.

13. An x-ray tube as defined in claim 10, wherein the x-ray transmissive window is formed of ceramic.

14. An x-ray tube as defined in claim 10, wherein the cathode is at a high voltage potential, and the envelope, anode and high voltage cable receptacle are at ground.

15. An x-ray tube as defined in claim 10, wherein the cathode and window assembly extends from one side of the tube to another.

16. An x-ray tube as defined in claim 15, wherein the cathode and window assembly extends from one end of the tube to another.

17. An x-ray tube as defined in claim 10, wherein the high voltage cable receptacle is formed within the ceramic base.

18. An x-ray tube as defined in claim 10, wherein the cathode and window assembly includes a plurality of high voltage cable receptacles.

19. An x-ray tube as defined in claim 10, wherein the high voltage cable receptacle is located on the ceramic base opposite the cathode.

20. An x-ray tube as defined in claim 19, wherein the high voltage cable receptacle overlies the cathode.

21. A method comprising the following steps:

providing an x-ray tube including a rotatably mounted anode, a cathode and window assembly spaced relative to the anode and including an electrically insulative ceramic base defining an x-ray transmissive window, a cathode having at least one filament for emitting an electron beam therefrom located on an internal side of the ceramic base, and a high voltage cable receptacle located on an external side of the electrically insulative base, wherein the ceramic base extends between the cathode and high voltage cable receptacle and electrically insulates one from the other; and connecting a high voltage cable connector to the cathode through the high voltage cable receptacle, creating a high voltage potential between the high voltage cable connector and cathode, and electrically insulating the cathode from the high voltage cable connector with the ceramic base located therebetween.

22. A method as defined in claim 21, further comprising transmitting a first electron beam from the cathode onto a first focal spot defined within a first portion of the anode and emitting a first x-ray beam therefrom upon impingement of the first electron beam thereon, and transmitting a second electron beam from the cathode onto a second focal spot defined within a second portion of the anode and emitting a second x-ray beam therefrom upon impingement of the second electron beam thereon.

23. A method as defined in claim 22, comprising the step of transmitting the first and second electron beams substantially simultaneously.

24. A method as defined in claim 23, wherein the cathode and window assembly further includes first and second metalized conductive surfaces on opposite sides of the filament relative to each other, and the method further comprises controlling a voltage differential between the first and second metalized conductive surfaces and, in turn, controlling at least one of the electron beam size, shape, and direction based thereon.

25. A method as defined in claim 23, further comprising the step of connecting one end of the high voltage cable connector to the cathode, and the opposite end of the high voltage cable connector to an anode grounded power supply such that the cathode is at a high voltage potential and the envelope, anode and high voltage cable receptacle are at ground.

26. A method as defined in claim 22, comprising the step of transmitting the first electron beam onto a first focal spot, and the second electron beam onto a second focal spot spaced relative to the first focal spot.

* * * * *